United States Patent [19]

Kleinecke

[11] Patent Number: 4,463,335

[45] Date of Patent: Jul. 31, 1984

[54] MAGNETIC CIRCUIT FOR HIGH VOLTAGE CONTACTOR

[75] Inventor: John D. Kleinecke, Wichita Falls, Tex.

[73] Assignee: Siemens-Allis, Inc., Atlanta, Ga.

[21] Appl. No.: 377,397

[22] Filed: May 12, 1982

[51] Int. Cl.[3] ..... H01H 85/00; H01H 9/44

[52] U.S. Cl. ..... 337/4; 200/147 R

[58] Field of Search ..... 337/4, 5, 6; 200/147 R

[56] References Cited

U.S. PATENT DOCUMENTS

| | | | |
|---|---|---|---|
| 2,200,070 | 5/1940 | Amstrong et al. | 200/147 R |
| 2,635,158 | 4/1953 | Peter | 200/147 R |
| 3,403,239 | 9/1968 | Schramm et al. | 337/4 |

*Primary Examiner*—Harold Broome

*Attorney, Agent, or Firm*—John L. James

[57] ABSTRACT

A contactor of the high-voltage type utilizing an arc chute and aligned magnetic pole pieces for urging an arc into the chute for quenching. A pair of rigid bus bars extend upon either side of the arc chute assembly, and are projected along the edges of the pole piece to supplement the arc displacement capability of the pole pieces, particularly at higher current values.

10 Claims, 6 Drawing Figures

MAGNETIC CIRCUIT FOR HIGH VOLTAGE CONTACTOR

BACKGROUND OF THE INVENTION

The present invention relates to high voltage contactors, and more particularly to an improved, synergistic system for supporting a magnetic field in the arc chute thereof.

Electrical contactors, as distinguished from circuit breakers, are not only called upon to interrupt load currents but also to institute such currents by making a circuit under load. Contactors do this repeatedly and regularly in order to start and stop electrical equipment on a routine basis. Hence the requirements, duty cycles, and construction of contactors differ markedly from circuit breakers, which are only called upon to operate under unusual circumstances, ordinarily when an overcurrent failure has occurred. Owing to the fact that circuit breakers operate only in the presence of high currents, breakers are known which utilize "linear" coils of conductors which provide a magnetic field adjacent the contacts for urging an arc into an arc chute for quenching. Other constructions are known, principally for lower current values, in which flux produced by a current-carrying coil is transferred to the appropriate arc chute area by means of magnetic pole pieces.

Unlike circuit breakers, contactors are ordinarily called upon to make and break operating-level currents, though on occasion higher currents must be dealt with. So-called air magnetic contactors of the high voltage variety necessarily make use of an arc chute for quenching the arc which is drawn upon interruption of heavy currents. Such arc chutes are conventionally used in conjunction with magnetic pole pieces and current-carrying coils which give rise to an arc-displacing magnetic field within the arc chute. This gives rise to occasional problems, however, in that the magnetic circuit has a tendency to saturate at high current levels which diminishes the capacity of the system to extinguish severe arcs. Conventionally this problem has been overcome by providing larger and thicker pole pieces.

With one type of contactor construction, load current is routed through conductors which extend along the tops of the arc chutes. The magnetic fields about these conductors tend to oppose, and therefore weaken, the magnetic field in the upper part of the arc chute which is produced by the pole pieces. To make matters worse, as current increases and produces a still stronger arc, the opposing magnetic field also increases and therefore diminshes the value of the arc-quenching field. It will therefore be understood that it would be highly advantageous to provide an improved magnetic circuit for high voltage contactors which eliminates difficulties with opposing flux fields, and encourages the movement of an arc into a quenching zone.

It is therefore an object of the present invention to provide a contactor assembly having improved arc extinguishing characteristics.

Another object is to provide an improved, synergistic magnetic circuit for a high voltage contactor.

Yet another object is to provide an improved magnetic circuit for a high voltage contactor which does not require the increased use of magnetic materials.

Yet another object is to provide a current routing system in an air-magnetic contactor which markedly improves the arc extinguishing capabilities thereof.

SUMMARY OF THE INVENTION

Briefly stated, in accordance with one aspect of the invention the foregoing objects are achieved by providing a pair of pole pieces on either side of an arc chute extending above the contacts of an electrical contactor assemly. A load current-carrying coil is disposed between extending ends of the pole pieces, giving rise to a magnetic field which is conveyed by the pole pieces across a region within the arc chute. A pair of support members extending transversely to the arc chute, and on either side thereof, support load current-carrying bus bars. The bars are formed into a U-shape with the opposed ends secured to the supports, and the center sections thereof extending across the lower end of the arc chute on both sides thereof in the region of the electrical contacts.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
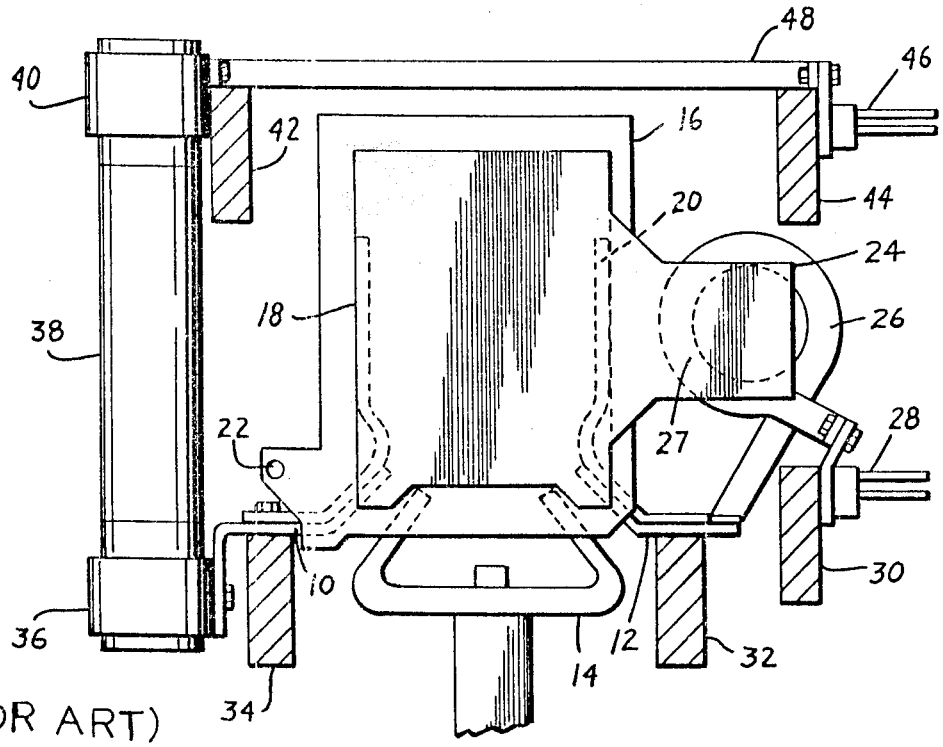
(PRIOR ART) Fig. 1
FIG. 1 is a partly sectioned elevation view of a contactor assembly.

FIG. 1 is a side elevation view of a high voltage contactor, with side panels removed to show the basic structures therein. The contactor comprises a pair of stationary contacts 10, 12 which are bridged by a movable conductive armature 14 which reciprocates vertically, driven by a solenoid or the like. An arc chute 16 is disposed about, and extends above, the contacts and encloses the usual baffles (not shown) and arc horns 18 and 20, which are shown by dotted lines. The arc chute is pivoted on a pin 22 to facilitate inspection of the contacts and a pair of pole pieces, only one of which is visible and indicated as item 24, are disposed on opposite sides of the arc chute. Each pole piece comprises a set of laminated steel sheets which are affixed at either side of the arc chute and include neck sections 27 which extend to the opposite ends of a conductive coil 26. The coil is coupled at one end to contact 12, and at the other to a set of conductive fingers 28 which engage stationary contacts in the enclosure in which the contactor is disposed. Fingers 28 are mounted upon a support 30 which extends transversely to the arc chute, and is supported at either end by appropriate portions of the contactor assembly. Another support 32 extends in the same manner, and bears stationary contact 12. At the front of the assembly another support 34 bears contact 10, which in turn is coupled to a clip 36. A fuse 38 extends between clip 36 and a second, similar clip 40 which is supported by another transverse support 42. Support 44, located toward the rear of the contactor assembly, carries another set of spring-loaded fingers 46 which engage the "line" contacts in the enclosure in which the contactor is to be installed. A pair of bus bars couple fingers 46 and clip 40, only one bus bar 48 being visible in the figure. In practice, the bus bars are separated, one running above either side of arc chute 16. Further details of construction of a contactor assembly of the type depicted may be found in copending application Ser. No. 373,030 filed Apr. 28, 1982 for "Fabricated Carriage Assembly for High Voltage Contactor'-'—Farag et al.

With fingers 28 and 46 engaging the load and line connections, respectively and armature 14 move upwardly to form an electrical connection between stationary contacts 10 and 12, current flows through fingers 46, bus bars 48 and through fuse 38 by way of clips 40 and 36. The current is then conducted from stationary contact 10 through armature 14, thence to contact 12 and through coil 26 where it gives rise to a magnetic field in a direction perpendicular to the plane of the Figure. The current then flows out fingers 28 to a load.

When current flow is to be interrupted, armature 14 is caused to move downwardly, creating gaps between itself and stationary contacts 10 and 12. If a relatively high current is flowing the current does not cease immediately but rather forms an arc, first between the stationary contacts and the armature, then from one stationary contact to the other. Due to the continued current flow the magnetic field set up by coil 26 continues in effect, forming a magnetic circuit which extends through the center of the coil, transversely through pole shoe 24, and thence transversely through the arc chute so that a magnetic field normal to the plane of the Figure exists within the arc chute including the area between contacts 10 and 12. The magnetic flux in this area causes an upward force on the arc in accordance with well known principles of electromagnetic phenomena. The arc, now extending between arc horns 18 and 20, is urged further upwardly into the arc chute into an area where it encounters a number of serrated baffles where it is elongated, cooled and finally extinguished. It will be understood that coil 26 is wound in a direction such that the interaction of the flux produced within the arc chute and the current flow supported by the arc causes the arc to move upwardly. When the alternating current reverses, the direction of the magnetic flux also reverses so that an upward force is maintained. Tracing the current flow in the illustrated circuit, it will become apparent that the direction of current flow in bus bars 48, e.g., from right to left, is opposite the direction of current flow in the arc extending from contact 10 to contact 12. The flux field set up around bus bars 48 is opposite to that created by the pole pieces 24, and accordingly the fringe effects of the magnetic flux from the bus bars weakens the magnetic field toward the upper part of the arc chute. This has the effect of preventing the migration of the arc upward into the chute and allowing it to be rapidly extinguished.

Figure 2A:
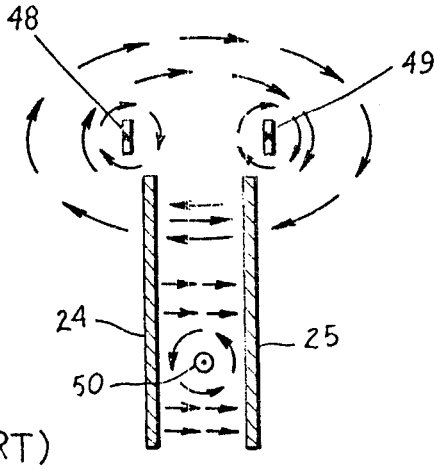
(PRIOR ART) Fig. 2a
FIGS. 2*a* and 2*b* illustrate magnetic fields in the apparatus.

Referring now to FIG. 2*a* this effect is depicted in idealized form wherein pole piece 24 is shown along with its mate, identified as pole piece 25. Arc chute 16 has been deleted for purposes of clarity, as it does not affect the characteristics of the magnetic circuit. Bus bar 48 is illustrated extending above and to one side of pole shoe 24. In like manner another, mating bus bar 49 extends above and slightly to one side of pole piece 25. The magnetic flux set up by coil 26 (not visible in the figure) produces a field illustrated as extending from left to right. An electric arc 50 supports a field thereabout in accordance with the conventional right-hand rule in the same manner as a current within an electrical conductor. In the Figure, current flow is taken to be into the plane of the figure for bus bars 48 and 49, and out of the figure for arc 50, so that the magnetic fields are set up in clockwise fashion about bus bars 48 and 49. These fields link one another and give rise to a larger fringe field which also entends in a clockwise direction, and interacts with the field between pole pieces 24 and 25 to weaken the latter field and thus detract from the ability of the pole pieces to urge arc 50 in an upward direction. The straightforward way to overcome the problem of an insufficient flux-displacing field would ordinarily be to increase the field by adding turns to coil 26, adding magnetic material to the pole pieces, or both. However, these approaches require the use of substantial added materials and add to the cost and size of the apparatus.

Figure 2B:
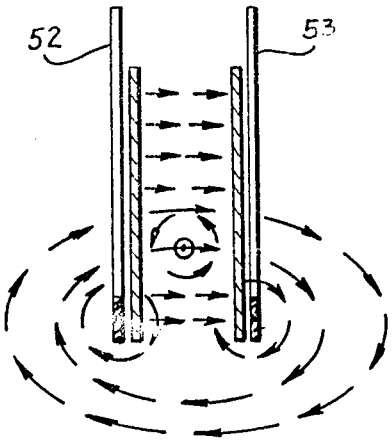

In accordance with the present invention, the current-carrying bus bars 48 and 49 are redirected about the area at the lower edges of the pole pieces, adjacent the fixed contacts of the contactor mechanism. As seen in FIG. 2*b*, conductors 48 and 49 are replaced by longer bars 52 and 53, respectively. The bars have U-shaped center sections which extend generally vertically downwardly along the edges of the pole pieces, and thence horizontally across the lower edges thereof so as to set up a generally clockwise flux distribution, substantially as shown. While the flux from conductors 52 and 53 is strongest in the region about the contacts, thus providing further force for urging an arc upwardly from the contacts 10 and 12 onto the arc horns, the fringing effects of the field also traverse other areas of the magnetic pole pieces, and add substantially to the field within the arc chute, causing the arc to be urged further upwardly.

The present inventor has found that aside from producing a vectorial addition, rather than a subtraction, of fluxes in the manner shown an overall increase in arc translation force is achieved due to the fact that the flux field about the current-carrying conductors 52, 53 increases linearly with current, while the flux produced through the magnetic pole pieces 24 and 25 is limited due to the saturation of the magnetic material. This in effect extends the current interruption capability of the arc chute, and makes it possible to use smaller, less expensive magnetic pole pieces. In one successfully tested embodiment, replacement of straight current carrying bars with U-shaped bars as shown as 52 and 53 actually doubled the arc interrupting capacity of an otherwise unmodified contactor assembly.

Figure 3:
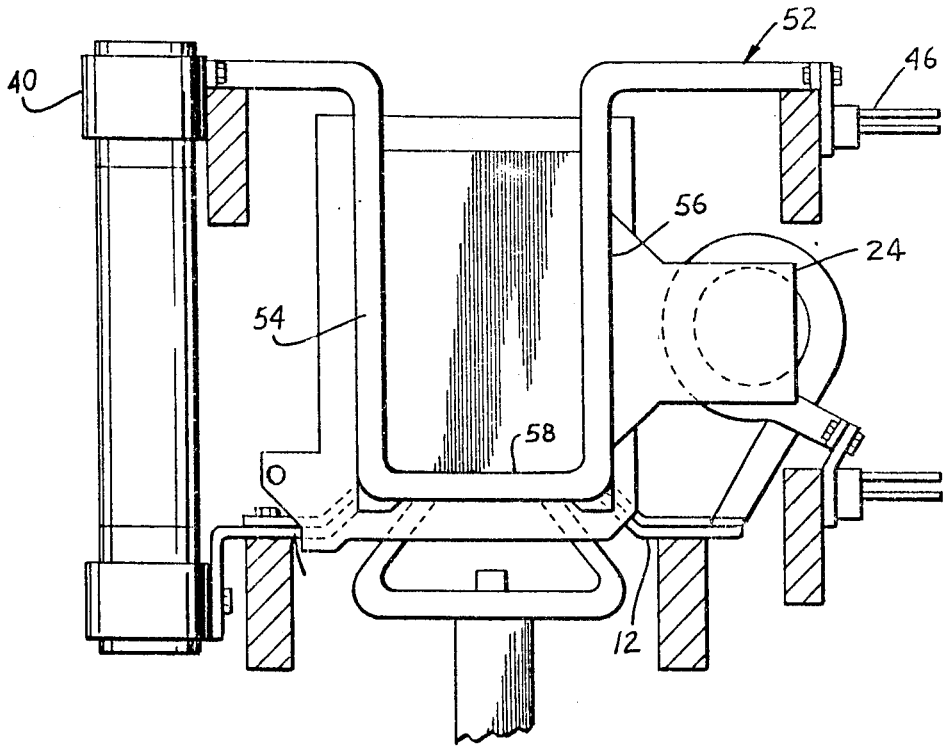
FIG. 3 is an elevational view of a contactor assembly making use of the present invention.

FIG. 3 represents a mechanism such as that of FIG. 1, modified in accordance with the principles discussed above. Although mating bar 53 is not visible in the figure, the generally U-shaped configuration of the bars is examplified by bar 52. The opposed ends of the bar are coupled to upper fuse clip 40 and to contact fingers 46 for conducting current from one to the other. The center section of the bar is formed in an extended U shape, the sides of the U extending along opposite edges of pole shoe 24, substantially as shown. The center of the U shaped member extends horizontally in the area of the fixed contacts 10 and 12 and substantially aids the magnetic field in this area. Also, and while not visible in the idealized diagram of FIG. 2*b*, the flux field about the vertical legs 54, 56 of the U shaped member give rise to a flux distribution substantially across the entire area of the arc chute. Due to the U-shaped configuration shown, the direction of the magnetic flux within the "U" is in a consistent direction, i.e., transverse to the arc chute and thus effective for forcing an arc upwardly in the chute, substantially throughout the entire area thereof.

Figure 4:
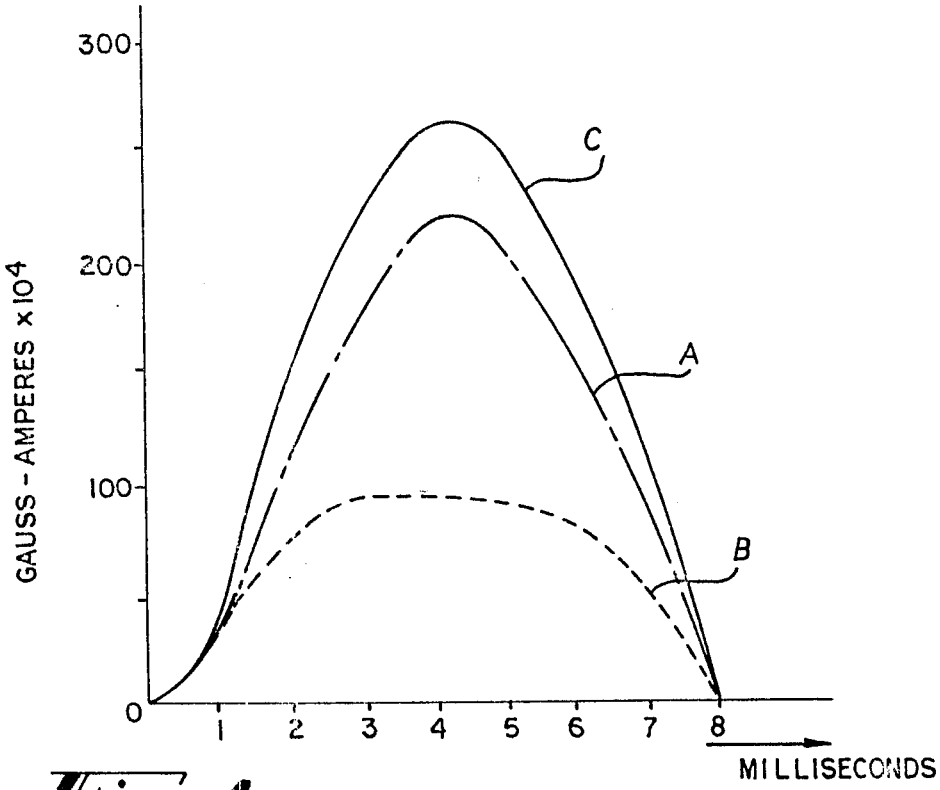
FIG. 4 is a graph representing the facts of the construction of FIG. 3.

Referring now to FIG. 4, there is shown a graph of electromotive force which is a vectorial product of the arc current and magnetic flux between the pole pieces of a contactor assembly such as illustrated in FIGS. 1 and 3, plotted as a function of time. Curve A illustrates the magnitude of electromotive force on the arc located between pole pieces 24 and 25 when current conducting bars 48 and 49 are not present or, to be more precise, are replaced by conductors whose fields do not interact with the magnetic flux between the pole pieces. The force which urges the arc upwardly generally follows the sinusoidal characteristic of a corresponding half-cycle of alternating current. With the straight bars 48, 49 installed as shown in FIGS. 1 and 2*a*, the offsetting effects of the fluxes causes the characteristic identified as curve B. The magnitude of the resultant electromotive force is considerably lower than before, illustrating the effects of the fringe field which is set up around the straight conductors. It should be apparent that the density of the flux increases as the distance to the bars decreases, and therefore that the weakening of the transverse magnetic flux is progressively greater as a function of height within the arc chute. Curve C illustrates the resulting force on the arc when bars 48, 49 are replaced by the U-shaped conductors 52 and 53 of FIGS. 2*b* and 3. In fact the U-shaped conductor bars add substantially to the flux density, significantly adding to the electromotive force which urges the arc upwardly in the chute for rapid extinction.

Figure 5:
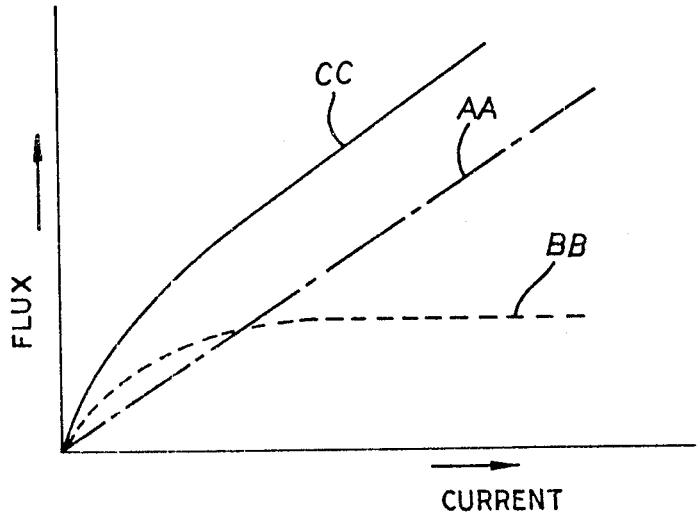
FIG. 5 illustrates the effect of the construction of FIG. 3.

FIG. 4 illustrates the added strength of the arc-displacing magnetic field which arises at low to medium current levels in the illustrated system. At higher current levels, however, the magnetic material of the pole pieces saturates so that the value of the magnetic field set up by the pole pieces, and illustrated by curve B, experiences little or no increase although current flow may increase drastically. In such a case the presence of the U-shaped conductor adds materially to the ability of the system to displace the arc upwardly in the arc chute, since the field which the bars produce impinges upon the broad cross section of the pole pieces and is hence transferred directly into the arc chute and does not depend upon a saturable magnetic path such as the narrow neck section which connects the broad area of the pole pieces with coil 26. The net effect is shown in FIG. 5, which is an idealized plot of magnetic flux as a function of current. While not drawn to scale, it will be understood that the magnetic flux versus current characteristic of the conductors 52, 53 and represented by straight line AA, continues to increase linearly with current. In contrast the flux field produced in the arc chute through the medium of the saturable pole pieces, shown by dotted line BB, rises rapidly at first but then levels off at a point where the magnetic material of the pole pieces becomes saturated. At this point, increases in current produce no further increase in flux and accordingly the field which is relied upon for displacing the arc into an extinguishing region does not increase during overcurrent conditions. While the point at which the system pole pieces saturate can be increased by making the pole pieces thicker and heavier, this is relatively uneconomical and further the ability to do this is circumscribed by space and electrical limitations.

By combining the U-shaped conductors 52, 53 with conventional pole pieces there is a net addition of magnetic flux, represented by curve CC. For lower current values the flux increases somewhat more rapidly than with conventional pole pieces alone. However at higher current values, where the pole pieces become saturated, the arc-displacing flux continues to increase, proportionately increasing the ability of the system to extinguish the larger and heavier arcs which result.

Rather than simply add the flux-producing capabilities of the U-shaped bars to an existing pole piece system, in the interest of economy the size and mass of the pole pieces may be reduced. It is therefore possible to reduce the size, and therefore the cost, of previously-used pole pieces owing to the salutary effects of the U-shaped conducting bars. Although some slight additional cost is incurred due to the extra length of the rerouted bars and the bending operations necessary to form them, this effect is more than compensated by the reduction in size and expense of the pole pieces.

It will be evident from the forgoing description that certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the application.

What is claimed as new and desired to be secured by Letters Patent of the United States is:

1. A circuit interrupter assembly for opening and closing an electric circuit, comprising contact means for making and breaking electrical current flowing to a load, an arc chute having a first, lower end disposed adjacent the contact means and a second, upper end remote from said contact means, said arc chute receiving an arc having a translational force; magnetic pole pieces extending on either side of said arc chute and creating pole flux; a coil coupled in circuit with said contact means for inducing a magnetic field transversely through said arc chute between said pole pieces; first and second support means extending transversely to said arc chute at opposite sides of the second, upper end thereof; means on one support electrically coupled to one of the contacts; means on the other support for releasably engaging an electrical contact; and flux means for creating a conductor flux vectorially adding the conductor flux and pole flux and increasing the arc translational force and extending the current interruption capability of the arc chute, said flux means including a conductor having opposed ends secured to said support means and a generally U-shaped center section extending adjacent the outer face of at least one of said pole pieces, the center portion of said U-shaped section extending substantially to the lower edges of said pole pieces adjacent the contact means.

2. The invention defined in claim 1, further including a removable fuse extending between said first upper support and one of said contacts; and wherein said engaging means on said other support comprises a plurality of spring-loaded conductive metal fingers.

3. The invention defined in claim 2 wherein there are provided two substantially parallel conductor means disposed on opposite sides of said arc chute, the opposed, parallel portions of said U-shaped sections of said conductor means extending generally vertically along opposite edges of said pole pieces.

4. The invention defined in claim 3, wherein said contact means comprise first and second fixed contacts and a single, movable contact; one of said fixed contacts being electrically coupled to said fuse means, the other of said fixed contacts being electrically coupled to said coil means.

5. The invention defined in claim 4, further including second means for releasably engaging another electrical contact, said second means comprising a plurality of spring-loaded metal fingers electrically coupled to the opposite end of said coil from said other of said fixed contacts.

6. In a contactor assembly for making and breaking electrical current flowing to a load including an arc chute having first and second ends, separable contact means adjacent the first end of said arc chute; a pair of planar, metal pole pieces extending on either side of said arc chute and coil means in circuit with said contacts for inducing a magnetic field between said pole pieces; a pair of rigid metal conductors coupled in circuit with said contacts and extending on either side of said arc chute, said conductors each having opposed, terminal ends adjacent the first, upper end of said arc chute and a generally U-shaped center section, the side members of said section extending generally along the edges of said pole pieces from the second to the first end of said arc chute and the center of said U-shaped section extending at opposide sides of said contact means thereby creating a flux distribution which vectorially adds to the pole flux, increasing the arc translational force and extending the current interruption capability of the arc chute.

7. The invention defined in claim 6, wherein said rigid conductor means comprise substantially flat metal bars.

8. The invention defined in claim 7, further including electrically conductive means extending generally parallel to the opposed legs of said U-shaped section for carrying current from one end of each bar to the contactor means.

9. The invention defined in claim 8, wherein said electrically conductive means comprises an electrical fuse.

10. In a contactor assembly for making and breaking electrical current flowing to a load including an arc chute having first and second ends, separable contact means adjacent the first end of said arc chute; a pair of planar, metal pole pieces extending on either side of said arc chute and coil means in circuit with said contacts for inducing a magnetic field between said pole pieces; a pair of rigid metal conductors coupled in circuit with said contacts and extending on either side of said arc chute, said conductors each having opposed, terminal ends adjacent the first, upper end of said arc chute and a generally U-shaped center section, the side members of said section extending generally vertically downwardly along the edges of said pole pieces and then horizontally across the lower edges of the pole pieces creating a generally clockwise flux distribution thereby providing an electromagnetic force urging the arc upward from the contact means into the arc chute.

* * * * *